United States Patent [19]

Jacques

[11] Patent Number: 4,732,236

[45] Date of Patent: Mar. 22, 1988

[54] DUAL IMPELLER PUMP

[75] Inventor: David L. Jacques, Rockford, Ill.

[73] Assignee: Sundstrand Corporation, Rockford, Ill.

[21] Appl. No.: 852,773

[22] Filed: Apr. 16, 1986

[51] Int. Cl.[4] ..... F01M 11/06

[52] U.S. Cl. ..... 184/6.2; 184/31; 415/98; 415/175

[58] Field of Search ..... 184/6.2, 31; 415/98, 415/99, 100, 110, 175, 143, 111, 112; 244/135 R, 135 C

[56] References Cited

U.S. PATENT DOCUMENTS

| | | | |
|---|---|---|---|
| 1,485,537 | 3/1924 | Vincent | 184/6.2 |
| 2,492,020 | 12/1949 | Thoresen | 184/6.2 X |
| 2,609,065 | 9/1952 | Douglas . | |
| 2,693,248 | 11/1954 | Gaubatz et al. . | |
| 2,713,981 | 7/1955 | Lansing | 244/135 R |
| 2,732,002 | 11/1955 | Garnier | 184/6.2 |
| 2,804,022 | 8/1957 | Adams | 244/135 R X |
| 2,999,628 | 9/1961 | Crombie | 415/99 |
| 3,325,088 | 6/1967 | Keen et al. | 415/175 X |
| 3,532,443 | 10/1970 | Johnson | 417/367 |
| 4,153,141 | 5/1979 | Methlie . | |
| 4,525,995 | 7/1985 | Clark . | |
| 4,531,358 | 7/1985 | Smith . | |
| 4,541,784 | 9/1985 | Horler . | |

FOREIGN PATENT DOCUMENTS

| | | | |
|---|---|---|---|
| 1343011 | 10/1963 | France | 415/100 |

*Primary Examiner*—Leonard E. Smith

*Attorney, Agent, or Firm*—Wood, Dalton, Phillips, Mason & Rowe

[57] ABSTRACT

A liquid scavenging pump system for scavenging oil or the like from a blower, an engine or the like. A casing is provided for housing the blower and defining an oil receiving cavity. A dual pump is mounted in the casing and has first and second pumps in communication with the casing cavity for conjoint rotation. A first inlet is provided from the casing cavity to the first pump, and a first outlet is provided from the first pump for delivering oil from the cavity to a pump or the like. A second inlet is provided from the casing cavity, remote from the first inlet, to the second pump. The second outlet from the second pump is in communication with the first inlet to the first pump to facilitate operating the pump at various attitudes. The dual pump is of the radial-vaned impeller type, but includes two sets of axially spaced impeller vanes separated by a common barrier and including a sleeve for mounting on a common drive shaft. The impeller vanes, the barrier and the sleeve all are fabricated as a single unitarily constructed structure, such as by molding.

12 Claims, 4 Drawing Figures

FIG. 1
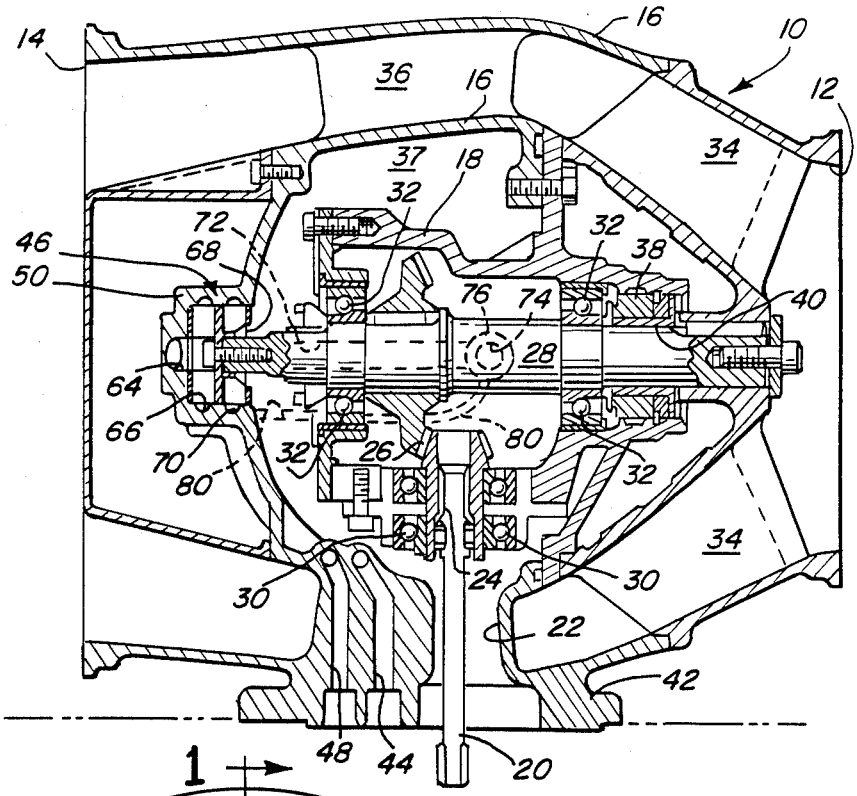
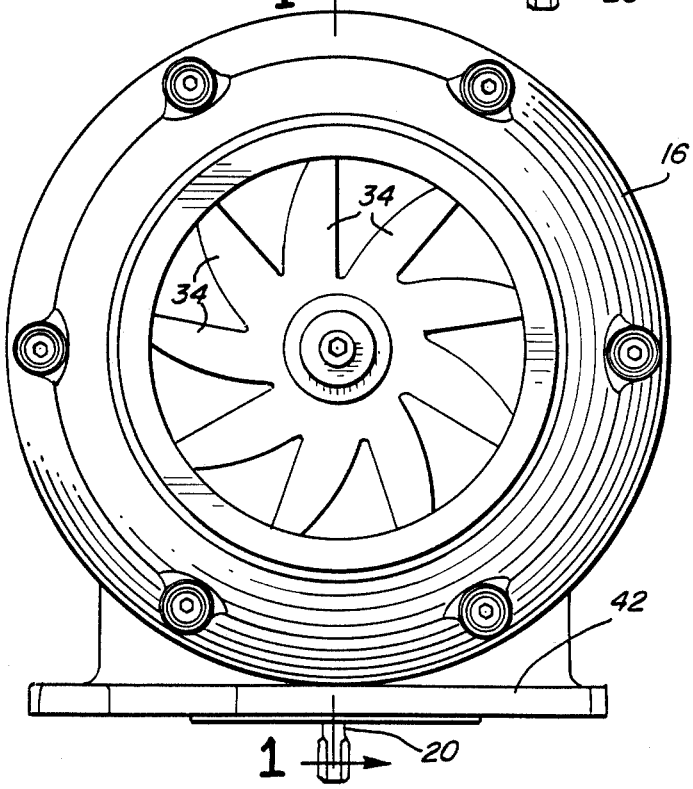
FIG. 2

FIG. 3
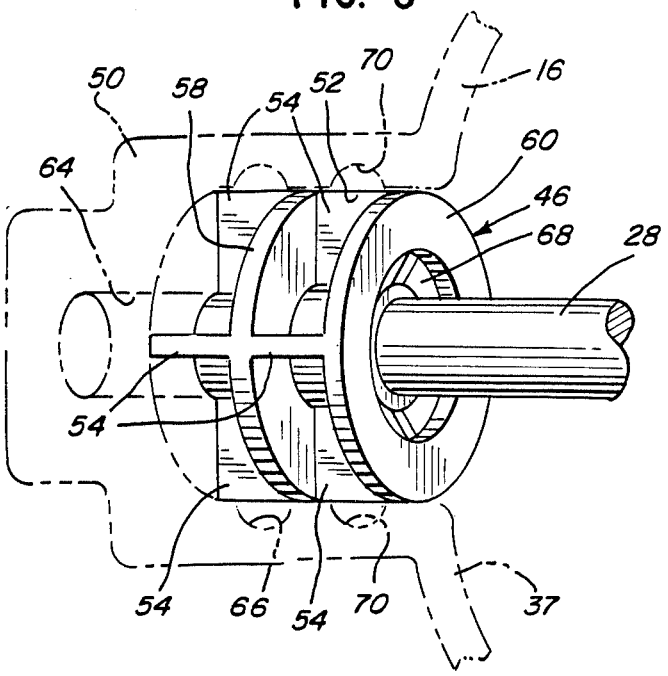
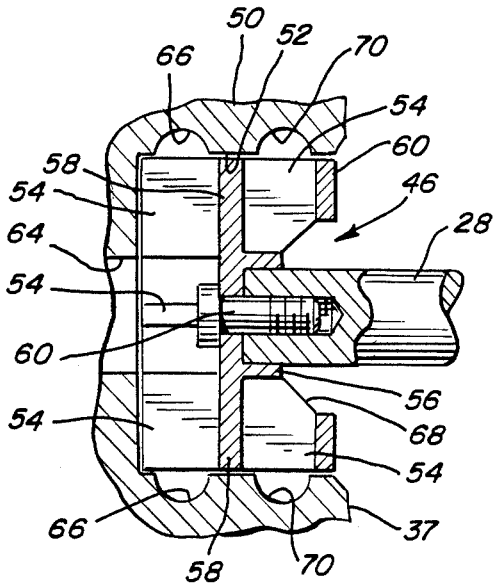
FIG. 4

DUAL IMPELLER PUMP

FIELD OF THE INVENTION

This invention generally relates to impeller pumps and, particularly, to a dual radial-vaned impeller pump for scavenging oil or other liquid from a blower, engine or similar operating mechanism.

BACKGROUND OF THE INVENTION

In aerospace applications, various operating machines or mechanisms, such as blowers or engines or the like, require the scavenging of oil or cooling fluids from all attitudes of the apparatus. This often is accomplished by a plurality of pumps, such as impeller pumps, fluid jet pumps or the like, which are located at various positions on the apparatus for scavenging oil from internal cavities in the casing or housing of the apparatus. Multiple pumps are required because the apparatus will attain different attitudes during flight, for instance. A single pump might draw air instead of oil at one attitude or another.

An example of such use of scavenging systems in aerospace applications is in a blower for an air particle separator on a turbine engine. Particles or foreign matter often are encountered, such as sand in desert environments or other debris. The turbine engine blades throw the air and particles outwardly by centrifugal force to a chamber, commonly called a "scroll", surrounding the turbine blades. The blower draws the air and particles from the scroll and evacuates the mixture to atmosphere. Because of the blower's aerodynamic configuration, scavenging of oil from the blower requires at least two inlets so that the housing does not become flooded at a given attitude.

Heretofore, scavenging systems for blowers or other apparatus of the character described above provided a separate pump for each of the inlets. Check valves then would be incorporated in the system so that the pumps do not try to draw air and oil simultaneously. Since the pumps are designed into the housing or casing for the blower, it often becomes difficult to provide check valves at various desired locations. It is readily apparent that such pump and valve systems not only can be complicated to design for a particular blower application, but weight and cost considerations often have to be ignored.

This invention is directed to solving one or more of the above problems by providing a dual pump of a substantially unitary construction and including separate pump means each dedicated to its own inlet and interconnected for scavenging oil from the blower at various attitudes.

SUMMARY OF THE INVENTION

An object of the invention, therefore, is to provide a novel liquid scavenging pump for scavenging oil or other liquid from a blower, engine or other operating apparatus.

In the exemplary embodiment of the invention, a casing is provided for housing the blower and defining an oil receiving cavity. A dual pump is mounted in a chamber in the casing and has first and second pump means in communication with the casing cavity. Specifically, first inlet means communicates between the cavity and the first pump means. First outlet means is provided from the first pump means for delivering oil from the cavity. Second inlet means communicates from the casing, remote from the first inlet means, to the second pump means. Second outlet means communicates between the second pump means and the first inlet to the first pump means to facilitate operating the pump at various attitudes. Therefore, it can be seen that no check valves or other valving systems are required as is prevalent with prior art scavenging systems described above.

The dual pump itself is a radial-vaned impeller type pump generally comprising two back-to-back paddle wheel pumps isolated from each other by a wall or barrier. The pumps are fabricated or molded as a single manufactured component, including a sleeve passing axially therethrough for receiving one end of a common drive shaft. The rotatable structure, including the pump impeller vanes, the dividing barrier and the shaft-receiving sleeve is rotatable as a unitary structure within a cylindrical chamber formed in the blower casing in communication with the casing cavity for the blower.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a horizontal, substantially axial section through a blower apparatus incorporating the dual pump of the invention, and taken generally along line 1—1 of FIG. 2;

FIG. 2 is an end elevation looking toward the right-hand end of FIG. 1;

FIG. 3 is a perspective view, on an enlarged scale, of the components of the dual pump of the invention; and FIG. 4 is an axial section through the pump of FIG. 3.

DETAILED DESCRIPTION OF THE PREFERRED EMBODIMENT

Referring to the drawings in greater detail, and first to FIG. 1, a blower, generally designated 10, is illustrated for use on a turbine engine as an air particle separator. The blower has an air inlet 12 which is in communication with appropriate ducting from the scroll surrounding the turbine engine blades into which air and foreign particles are thrown outwardly by centrifugal force during operation of the turbine engine. Blower 10 is designed for drawing the air and particles from the turbine engine scroll and evacuating the mixture to atmosphere through a blower outlet 14.

More particularly, blower 10 includes an outer casing 16 and an inner housing 18. A rotating shaft 20 extends horizontally through an opening 22 into the blower. The shaft is connected by a spline joint 24 and meshed gears 26 to a drive shaft 28. Bearings 30 are provided about rotating shaft 20, and bearings 32 are provided about drive shaft 28.

Drive shaft 28 is coupled to blower blades 34 for drawing air and particles in through inlet 12 and evacuating the mixture to atmosphere through outlet 14.

Curved stators 36 are provided in the air flow path between inlet 12 and outlet 14, the stators being curved opposite the direction of blower blades 34 to direct the air and particles in a substantially linear path through the blower.

Outer casing 16 defines an internal cavity 37 surrounding inner housing 18 and the motive components of the blower, such as drive shaft 38, gears 26, etc. A face seal 38 and a liner seal 40 isolate cavity 37 from the forward end of casing 16 and the connection between drive shaft 38 and blower blades 34.

The entire blower 10 is mounted by a base frame 42 onto the turbine engine to mount the blower with its inlet 12 in communication with the scroll or chamber that surrounds the turbine blades.

Oil is provided into blower cavity 37 through an oil inlet 44 in communication with cavity 37 between outer casing 16 and inner housing 18. The oil is provided for lubricating spline shaft 24, gears 26, bearings 30, bearings 32 and the other moving components of the blower motive mechanism. The invention contemplates a novel dual radial-vaned impeller pump, generally designated 46, for scavenging the oil from cavity 37 and returning the oil through oil outlet 48 to the oil sump. The dual pump is operatively associated with the rear end of drive shaft 28 for operation thereby. The dual pump is contained within a rearwardly projecting, generally cylindrical casing portion 50 on line with the axis of drive shaft 28.

More particularly, referring to FIGS. 3 and 4 in conjunction with FIG. 1, dual pump 46 is a dual radial-vaned impeller pump comprised of two back-to-back paddle wheel pumps mounted within a cylindrical chamber 52 formed in casing portion 50 axially aligned with drive shaft 28. The dual pump is integrally formed by a plurality of impeller vanes 54 radiating outwardly from an integral sleeve 56 which receives the distal end of drive shaft 28. A disc-shaped barrier or wall 58, disposed intermediate the ends of the impeller vanes and an inner disc-shaped barrier 60, isolates the two back-to-back paddle wheel pumps defining separate pumping chambers within overall chamber 52 in casing portion 50. In essence, barrier 58 divides and separates the two distinct but integral pump means, while barrier 60 isolates interior cavity 37 from the pumping chambers. A bolt 60 (FIG. 4) secures the unitary pump to the rear distal end of drive shaft 28.

It can be seen that the entire dual radial-vaned impeller pump 46, including impeller vanes 54, sleeve 56 and barriers 58 and 60 all are fabricated as a unitary or single component, such as of molded plastic or the like. The ease and reduced cost of manufacture are readily apparent.

In order to facilitate the description hereinafter, the left-hand pump means of the above-described dual pump (as viewed in FIGS. 1, 3 and 4) will be referred to as the first pump means, and the right-hand pump means of the dual pump will be referred to as the second pump means.

The liquid scavenging pump system of the invention includes an axial inlet 64 to the first pump means, and an outlet defined by an annular chamber 66 in casing portion 50 surrounding the impellers of the first pump means. The second pump means include an axial inlet 68, and an outlet defined by an annular chamber 70 surrounding the impeller vanes of the second pump means. Outlet 66 of the first pump means is in communication with oil outlets 48 (FIG. 1) in casing 16 by means of appropriate passages (not shown) in the casing for effectively delivering oil from the casing cavity 37.

In order to scavenge oil from the casing cavity at different locations to accommodate different attitudes of pump 10, inlet 64 of the first pump means is extended by an internal passage 72 (FIG. 1) extending through the walls of casing 16 to an inlet opening 74 surrounded by a funnel 76. Therefore, oil is scavenged into the first pump means from a location 74 located forwardly of casing cavity 37 at the bottom thereof, and oil is scavenged into the second pump means by inlet 68 located rearwardly of the casing cavity generally at the axial center area thereof. This allows for scavenging of the oil at any attitude of the blower and the associated turbine engine.

In order to prevent the dual pump system from becoming "starved" by attempting to draw air instead of oil into the pump, outlet 70 of the second pump means communicates through a passage 80 (FIG. 1) forwardly through the walls of casing 16 and in communication with inlet opening 74 to the first pump means. Therefore, a closed circuit is formed between the outlet 70 of the second pump means to the inlet 74,64 of the first pump means. In this manner, the dual pump will always draw oil and never be starved because of the presence of air in the system.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A liquid scavenging pump system for scavenging oil or the like from a blower, an engine or the like, comprising:

a casing for housing the blower and defining an oil receiving cavity;

a dual pump having first and second pump means mounted in communication with the casing cavity for conjoint rotation;

first inlet means from the casing cavity to the first pump means;

first outlet means from the first pump means for delivering oil from the cavity;

second inlet means from the casing cavity, remote from the first inlet means, to the second pump means; and second outlet means from second pump means in communication with the first inlet to the first pump means to facilitate operating the pump at various attitudes.

2. The pump system of claim 1 including a common drive shaft for conjointly rotating the first and second pump means.

3. The pump system of claim 2, including common barrier means dividing and separating the first and second pump means.

4. The pump system of claim 3 wherein said barrier means is integral with the first and second pump means for rotation therewith.

5. The pump system of claim 1 wherein said dual pump is of the radial-vaned impeller type, with said first and second pump means being defined by two distinct sets of axially spaced impeller vanes.

6. The pump system of claim 4, including a common drive shaft for conjointly rotating both sets of impeller vanes.

7. The pump system of claim 5, including common barrier means between and separating the two sets of impeller vanes.

8. The pump system of claim 7 wherein said barrier means is integral with the two sets of impeller vanes.

9. The pump system of claim 8, including a common drive shaft for conjointly rotating both sets of impeller vanes.

10. The pump system of claim 9 wherein said drive shaft, said barrier means and said sets of impeller vanes all are fixed as a unitary rotatable structure.

11. The pump system of claim 10 wherein said unitary structure is mounted in a common cylindrical chamber in said casing.

12. The pump system of claim 10 wherein said first and second inlet means and said first and second outlet means are formed in said casing.

* * * * *